US008827764B2

(12) United States Patent
Caruso et al.

(10) Patent No.: US 8,827,764 B2
(45) Date of Patent: Sep. 9, 2014

(54) SHAPE CONTROL GARMENT HAVING UNIFORM OUTER APPEARANCE

(75) Inventors: Danielle Caruso, Tinton Falls, NJ (US); Catherine Shannon, Brooklyn, NY (US)

(73) Assignee: Maidenform LLC, Winston-Salem, NC (US)

( * ) Notice: Subject to any disclaimer, the term of this patent is extended or adjusted under 35 U.S.C. 154(b) by 425 days.

(21) Appl. No.: 12/826,796

(22) Filed: Jun. 30, 2010

(65) Prior Publication Data

US 2011/0003533 A1 Jan. 6, 2011

Related U.S. Application Data

(60) Provisional application No. 61/222,263, filed on Jul. 1, 2009.

(51) Int. Cl.
*A41C 3/00* (2006.01)
*A41B 9/06* (2006.01)

(52) U.S. Cl.
CPC ..... *A41B 9/06* (2013.01); *A41B 2400/38* (2013.01)
USPC ..... 450/30; 450/10

(58) Field of Classification Search
USPC ..... 450/94, 95, 96, 100, 106, 112, 30–33, 450/60–64, 8–10, 23; 2/73, 78.1–78.4, 2/111–113, 67, 69
See application file for complete search history.

(56) References Cited

U.S. PATENT DOCUMENTS

| | | | |
|---|---|---|---|
| 357,068 | A | 2/1887 | Dalby |
| 570,696 | A | 11/1896 | Brown |
| 933,739 | A | 9/1909 | Bodensiek |
| 1,110,749 | A | 9/1914 | De Blieux |
| 1,121,005 | A | 12/1914 | Farnsworth |
| 1,191,865 | A | 7/1916 | Workman |
| 1,249,446 | A | 12/1917 | Well |
| 1,683,510 | A | 9/1928 | Weise |

(Continued)

FOREIGN PATENT DOCUMENTS

| | | | |
|---|---|---|---|
| DE | G 85 13 103.2 | U1 | 8/1985 |
| DE | 20 2005 000 716 | U1 | 3/2005 |

(Continued)

OTHER PUBLICATIONS

Skinny Cami Camisole, Apr. 2006, available at http://www.skinnycami.biz/files/.

(Continued)

*Primary Examiner* — Gloria Hale
(74) *Attorney, Agent, or Firm* — Dickstein Shapiro LLP

(57) ABSTRACT

A shape control garment includes: a fabric layer, formed in a shape operable to cover a portion of a wearer's body when the shape control garment is worn by the wearer, the fabric layer having: (a) an inner surface, facing the wearer's body when the shape control garment is worn by the wearer, and (b) an outer surface, facing away from the wearer's body when the shape control garment is worn by the wearer; and a control layer, affixed to at least a portion of the inner surface of the fabric layer so as to provide control and/or compression to a portion of the wearer's body, and not be viewable to an outside observer when the shape control garment is worn by the user.

10 Claims, 2 Drawing Sheets

(56) References Cited

U.S. PATENT DOCUMENTS

| | | | | |
|---|---|---|---|---|
| 1,774,613 | A | 9/1930 | Pidgeon | |
| 1,777,215 | A | 9/1930 | McGill | |
| 1,813,043 | A | 7/1931 | Foreman | |
| 1,886,049 | A | 11/1932 | Rothblum | |
| 1,931,822 | A | 10/1933 | Hoffman | |
| D91,329 | S | 1/1934 | Redman | |
| 1,977,329 | A | 10/1934 | Tobin | |
| 2,033,456 | A | 3/1936 | Cunningham | |
| 2,040,058 | A | 5/1936 | Mendel et al. | |
| 2,052,784 | A | 9/1936 | Martin | |
| 2,052,935 | A | 9/1936 | Moran | |
| 2,076,748 | A | 4/1937 | Schweig | |
| 2,097,777 | A | 11/1937 | Rothman | |
| D110,662 | S | 7/1938 | Rielly | |
| 2,190,030 | A | 2/1940 | Kops | |
| D128,536 | S | 7/1941 | Weil | |
| D129,078 | S | 8/1941 | Monteil | |
| D129,894 | S | 10/1941 | Abeles | |
| 2,274,382 | A | 2/1942 | Richman | |
| 2,310,103 | A | 2/1943 | McDonald | |
| 2,335,751 | A | 11/1943 | Friedman | |
| 2,579,547 | A | 12/1951 | Cadous | |
| D170,694 | S | 10/1953 | Kahn | |
| D174,038 | S | 2/1955 | Goldstein | |
| D174,114 | S | 3/1955 | Dior | |
| D174,115 | S | 3/1955 | Dior | |
| D174,194 | S | 3/1955 | Prochaska | |
| D177,982 | S | 6/1956 | Kahn | |
| D181,626 | S | 12/1957 | Cassini | |
| 2,963,022 | A | 12/1960 | Spetalnik | |
| D191,347 | S | 9/1961 | Herman | |
| 3,026,875 | A | 3/1962 | Kaupp | |
| 3,036,574 | A | 5/1962 | Jeffrey | |
| 3,060,446 | A | 10/1962 | Horne | |
| 3,066,675 | A | 12/1962 | Herman | |
| 3,217,713 | A | 11/1965 | Kunel | |
| D211,231 | S | 6/1968 | Salisky | |
| 3,421,513 | A | 1/1969 | Landau | |
| 3,422,818 | A | 1/1969 | Erteszek | |
| 3,454,013 | A | 7/1969 | Cahill | |
| 3,479,844 | A | 11/1969 | Silvain | |
| 3,556,106 | A | 1/1971 | Rosner | |
| 3,582,993 | A | 6/1971 | Keller | |
| 3,678,514 | A | 7/1972 | Safrit | |
| 3,699,590 | A | 10/1972 | Webber et al. | |
| D234,649 | S | 4/1975 | Lo Cascio | |
| D239,475 | S | 4/1976 | Lo Cascio | |
| 3,949,426 | A | 4/1976 | George | |
| 4,377,007 | A | 3/1983 | Sudjian | |
| 4,916,755 | A | 4/1990 | Feigenbaum et al. | |
| 4,956,878 | A * | 9/1990 | Boynton | 2/67 |
| RE33,406 | E * | 10/1990 | Wior | 2/67 |
| 4,976,653 | A * | 12/1990 | White | 450/155 |
| 5,083,316 | A | 1/1992 | Kuehner | |
| 5,094,648 | A | 3/1992 | Turner | |
| 5,461,725 | A | 10/1995 | Witczak | |
| 5,566,392 | A | 10/1996 | Dzelzkalns | |
| 5,605,060 | A | 2/1997 | Osborne | |
| D391,740 | S | 3/1998 | Barrington et al. | |
| 5,915,531 | A | 6/1999 | Hilpert et al. | |
| 6,000,993 | A | 12/1999 | Erwin | |
| 6,061,832 | A | 5/2000 | Morrison, Jr. | |
| 6,185,741 | B1 | 2/2001 | Kehoe | |
| 6,276,175 | B1 * | 8/2001 | Browder, Jr. | 66/171 |
| D452,600 | S | 1/2002 | Kim | |
| D453,058 | S | 1/2002 | Kim | |
| D453,255 | S | 2/2002 | Kim | |
| 6,430,748 | B1 | 8/2002 | Burkhart | |
| 6,443,805 | B1 | 9/2002 | Kirkwood | |
| D476,464 | S | 7/2003 | Jenkins | |
| 6,846,217 | B1 | 1/2005 | Struble et al. | |
| D556,978 | S | 12/2007 | Thunstedt | |
| 7,340,780 | B2 | 3/2008 | Levy | |
| 7,395,557 | B1 | 7/2008 | Ledyard | |
| D595,480 | S | 7/2009 | Giugliano | |
| D606,285 | S | 12/2009 | Schindler | |
| D616,627 | S | 6/2010 | Schindler | |
| D622,477 | S | 8/2010 | Schindler | |
| 8,123,590 | B2 | 2/2012 | MacKinnon | |
| 8,574,027 | B2 * | 11/2013 | Kipnes | 450/31 |
| 2006/0242748 | A1 | 11/2006 | Martz | |
| 2007/0077860 | A1 * | 4/2007 | Brooks | 450/155 |
| 2007/0094765 | A1 | 5/2007 | Summers et al. | |
| 2008/0034476 | A1 * | 2/2008 | MacKinnon | 2/228 |
| 2008/0078208 | A1 | 4/2008 | Kronbach | |
| 2008/0134409 | A1 * | 6/2008 | Karasina | 2/117 |
| 2008/0229474 | A1 | 9/2008 | Fons et al. | |
| 2008/0244805 | A1 * | 10/2008 | Griffin | 2/74 |
| 2008/0256676 | A1 * | 10/2008 | Di Lorenzo | 2/67 |
| 2010/0011481 | A1 | 1/2010 | Kipnes | |
| 2011/0225696 | A1 * | 9/2011 | Di Lorenzo | 2/67 |

FOREIGN PATENT DOCUMENTS

| | | | |
|---|---|---|---|
| EM | RCD 3855620-0106 | A1 | 1/2005 |
| EM | RCD-454202-0027 | A1 | 2/2006 |
| EM | RCD-454202-0121 | A1 | 2/2006 |
| EM | RCD-633755-0027 | A1 | 1/2007 |
| EM | RCD-730403-0023 | A1 | 10/2007 |
| GB | 116526 | A | 6/1918 |
| GB | 212307 | A | 3/1924 |
| GB | 1 603 600 | A | 11/1981 |
| GB | D3020687 | | 7/2005 |
| GB | D4004524 | | 10/2007 |
| JP | 2-82707 | U | 6/1990 |
| JP | 2001-172806 | A | 6/2001 |
| JP | 2002-138302 | A | 5/2002 |
| JP | 2003-129303 | A | 5/2003 |
| JP | 2005-281893 | A | 10/2005 |
| JP | 2006-316359 | A | 11/2006 |
| JP | 2007-146337 | A | 6/2007 |
| JP | 2007-303002 | A | 11/2007 |
| JP | 2008-156812 | A | 7/2008 |

OTHER PUBLICATIONS

Nancy Ganz Belly Band Convertible Bodybriefer 3313, Nov. 2007.
Spanx Hide & Sleek Full Slip 060A, Oct. 2007.
WWD Intimates, Mar. 7, 2005.
WWD Intimates, 2006 (2pgs).
Too Busy for the Gym?, Glamour.com, Oct. 24 2007, (1pg).
Spanx Hide & Sleek Cami 050, Oct. 30, 2007 (2pgs).
InStyle Magazine, Sep. 2007, Wolford Slip, (6pgs).
Underwire Torso Trim, Sassybax.com, Oct. 2007, (2pgs).
Tummy Tee, Redefyne, Oct. 2005, available at http://www.redefyne.com/tummytee.html.
Flirations Corset, Subtract Line, 1995 (1pp).
U.S. Appl. No. 61/021,212, filed Jan. 15, 2008.
Vogue Magazine, Apr. 15, 1960, bathing suit.
Target ad in Self Magazine, Jun. 2007, for Champion tanks.
Self Magazine, Jun. 2000, second row third bathing suit.
Self Magazine, Jan. 2006, featuring Nike.
Self Magazine, Dec. 2007, pink Nike tank.
Self Magazine, Apr. 2002, Puma Tank (bottom corner).
Lucky Magazine, Oct. 2006, Pink Eberjey Cami.
Lucky Magazine, Oct. 2003, Sereha's tank.
Lucky Magazine, Jan. 2002, Lace Trimmed Chemise.
JC Penney Catalog, 2002-2003.
JC Penney Catalog, 2006, Bellybra.
File History for U.S. Appl. No. 11/478,247 (corresponds to Publication No. US 2007/0094765 A1).

* cited by examiner

SHAPE CONTROL GARMENT HAVING UNIFORM OUTER APPEARANCE

CROSS-REFERENCE TO RELATED APPLICATION

This application claims benefit under 35 U.S.C. §119(e) of U.S. Provisional application No. 61/222,263, filed Jul. 1, 2009, the entirety of which is incorporated herein by reference.

FIELD OF THE INVENTION

The present invention relates to a shape control garment, more particularly, to a shape control garment that has a uniform outer appearance.

BACKGROUND OF THE INVENTION

Many women have parts of their bodies that they are unhappy with, making them have an insecure feeling when wearing certain clothing. Foundation garments have been worn for a very long time to address this problem. Better known today as shapewear, these foundation garments include body briefs, bodysuits, brassieres, control panty hose, control panties, control briefs, control slips, control camisoles, control tanks, hip slips, waist shapers, corsets, garter belts, and girdles.

Shapewear are undergarments designed to change the wearer's shape, producing a more fashionable, slim figure and to enhance the natural curves of the body. Take for example control briefs. They are designed to lift a wearer's bottom, flatten the tummy and add shape and form to the thighs. Depending on the particular fit chosen, the shapewear garment can also help eliminate unsightly underwear lines, thereby providing a smooth, contoured silhouette regardless of whether the outer garments are pants, skirts or dresses.

Shapewear is typically categorized according to the level or shape control offered—for instance, light, medium or firm. Generally, shapewear can be categorized into four different support levels:

- Light Control shapewear garments, which offer a slight touch of control without binding. These are typically chosen by women of all sizes who want to appear firmer, but not necessarily smaller.
- Moderate Control shapewear garments may have light control panels built in, offering control with a touch of compression. These are typically chosen by women who want to look more toned.
- Firm Control shapewear garments are the most popular with a support level that gives the maximum amount of compression and control. These are typically chosen by women seeking to appear slimmer and more toned.

Extra Firm Control shapewear garments offer the highest level of support. These garments will most likely have reinforced panels and possibly boning.

Shapewear garments are typically formed by providing a control panel material in a desired shape and size, and then forming the remainder of the shapewear garment about the control panel material. For example, in a typical shapewear tank, a fabric material is used to form the bust area of the garment, a control panel material is sewn to the bust area fabric to form the tummy area, and then a fabric material (typically the same as that of the bust area) is sewn to the control panel material to form the bottom of the garment. This results in a shapewear garment having the control panel material exposed on the outer surface thereof.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

SUMMARY OF THE INVENTION

Figure 1:
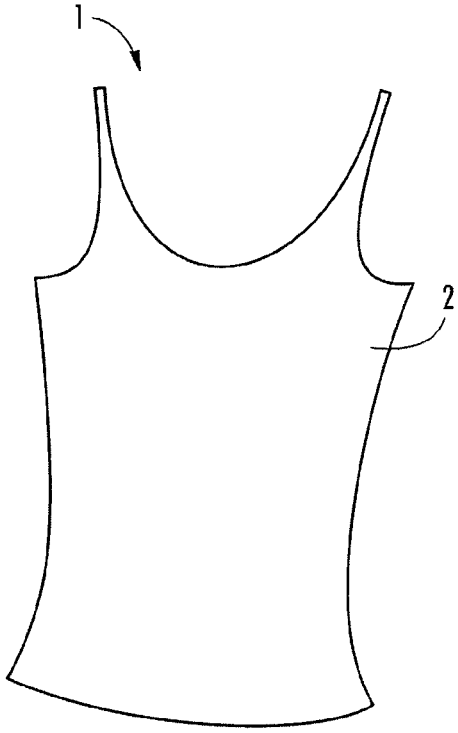
FIG. 1 is a plan view of a outer side surface of a shapewear garment of the present invention.

In accordance with a first aspect of the present invention, a shape control garment includes: a fabric layer, formed in a shape operable to cover a portion of a wearer's body when the shape control garment is worn by the wearer, the fabric layer having: (a) an inner surface, facing the wearer's body when the shape control garment is worn by the wearer, and (b) an outer surface, facing away from the wearer's body when the shape control garment is worn by the wearer; and a control layer, affixed to at least a portion of the inner surface of the fabric layer so as to provide control and/or compression to a portion of the wearer's body, and not be viewable to an outside observer when the shape control garment is worn by the user.

In another aspect, the fabric layer is a continuous, uniform fabric.

In another aspect, the fabric layer is formed of different fabric types attached together.

In another aspect, the fabric layer is made of one or more of fabrics selected from the group consisting of: lace, circular knit, warp knit, woven, cotton, nylon, polyester, and elastane.

In another aspect, the shape control garment is in the form of a tank top and the control layer is a tummy control panel.

In another aspect, the control layer is a power mesh material.

In another aspect, the shape control garment is in the form of a tank top, the fabric layer is made from about 87% nylon, 13% elastane, and the inner fabric layer comprises a control panel material made from about 82% nylon and 18% elastane.

In another aspect, the shape control garment is in the form of shorts, the fabric layer is made from about 87% nylon, 13% elastane, and the inner fabric layer comprises a control panel material made from about 82% nylon and 18% elastane.

In another aspect, the shape control garment further includes a lining on an inner surface of the garment, the lining being made of 100% cotton gusset.

In another aspect, the control layer is affixed to the inner surface of the fabric layer by sewing.

In another aspect, the control layer is affixed to the inner surface of the fabric layer by adhesive bonding.

In another aspect, the control layer is affixed to the inner surface of the fabric layer by ultra sonic bonding.

In another aspect, the shape control garment further includes transverse ornamental stitching viewable on the outer surface of the fabric layer that provides an appearance of separate garment sections for breast, tummy and bottom

DETAILED DESCRIPTION OF THE PREFERRED EMBODIMENTS

The present invention will next be illustrated with reference to the figures. Such figures are intended to be illustrative rather than limiting and are included herewith to facilitate the explanation of exemplary features of embodiments of the present invention. Unless otherwise noted, the figures are not to scale, and are not intended to serve as engineering drawings.

With current fashion trends, women have begun wearing shapewear undergarments as outerwear. If traditional shapewear garments are worn in this manner, this would result in exposing the control panel material to view, alerting all that a shapewear garment is being worn. Because of this, there is a need to provide a shape control garment that has the aesthetic appeal of outerwear, while also providing the benefits of a traditional shapewear foundation undergarment.

The present invention addresses such a need. Specifically, various embodiments of the present invention provide a shapewear garment, for example a control tank, that has a uniform outer appearance such that, when worn as outerwear, is not readily identifiable as a shapewear garment.

Figure 2:
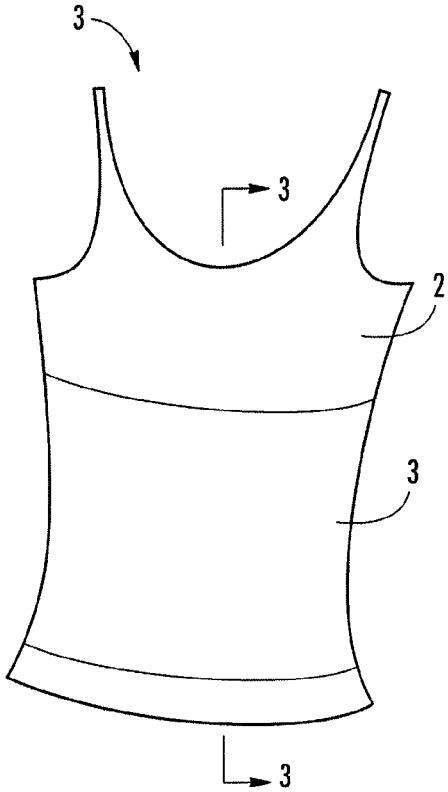
FIG. 2 is a plan view of an inner side surface of a shapewear garment of the present invention showing the control panel material.
Figure 3:
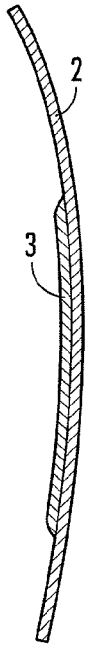
FIG. 3 is a cross sectional view along line 3-3 of FIG. 2.

As shown for example in FIGS. 1-3, this unique appearance is achieved by providing a shapewear garment 1 having an outer fabric layer 2 and a control panel material 3. The control panel material is attached to the inner, i.e., body facing, surface of the outer fabric layer 2.

As shown in FIGS. 1-3, due to its placement at the body facing surface of the outer fabric layer 2, the control panel material 3 is not visible from the outer side surface of the shapewear garment 1, allowing it to be worn even without an outer garment without making it obvious to viewers that the wearer is wearing a shapewear garment.

Preferably, the outer fabric layer 2 is a continuous, uniform outer fabric. The material of the outer fabric layer 2 can be selected from any fabric, such as lace, circular knit, warp knit, woven, cotton, nylon, polyester, elastane, or any combination thereof. It is also contemplated that the outer fabric layer can be formed from different fabric types attached together in the form of a traditional outerwear garment.

The control panel material 3 is preferably positioned in a location on the shapewear garment to provide the desired control in a hidden manner. For example, as shown in the shapewear garment 1 of FIGS. 1 and 2, i.e., a tank top, the control panel material 3 is positioned so as to provide control and/or compression to the tummy area of the garment while being hidden by the outer fabric layer 2.

In preferred embodiments, the control panel material 3 can be attached to the inner body facing surface of the outer fabric layer 2 by sewing, adhesive bonding, ultra sonic bonding, or any other means known in the art to attach fabric materials together. The shape and positioning of the control panel material 3 can be altered to provide control and/or compression to any desired targeted area of the wearer's body. The control panel material 3 is preferably a power mesh material, such as spandex or nylon/Lycra® blend, or any other material that can provide the desired control and/or compression, known or developed in the future.

Figure 4A:
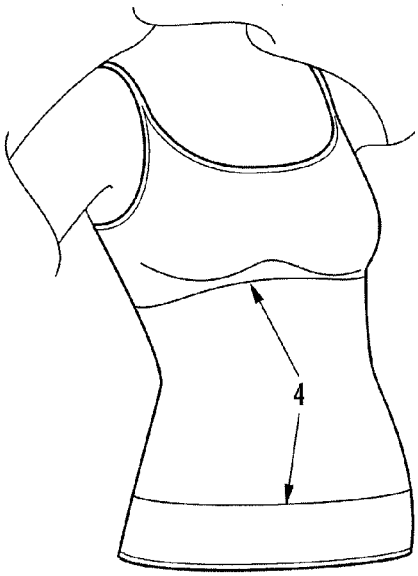
FIGS. 4A-4C are drawings showing various possible embodiments of the shapewear garment of the present invention.
Figure 4B:
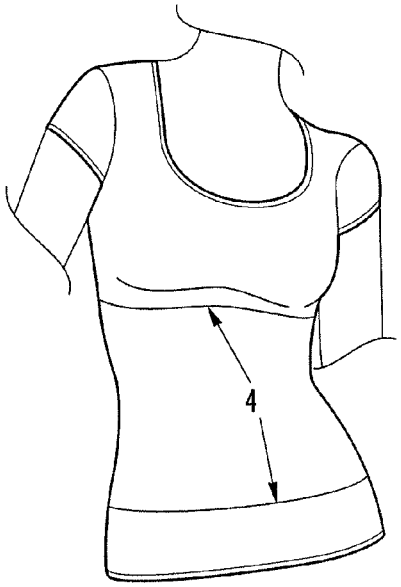
Figure 4C:
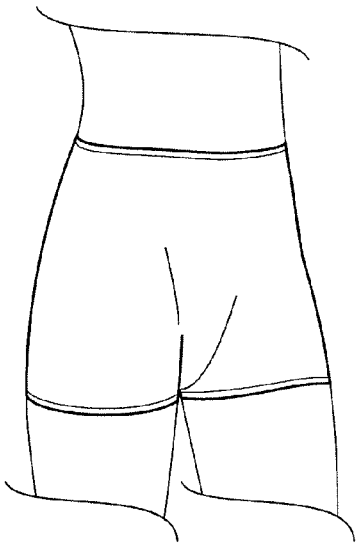

FIGS. 4A-4C show various possible embodiments of the shapewear garment in accordance with the present invention, such as a tank top, a t-shirt and shorts. In the examples shown in FIGS. 4A-4C, the tank top (FIG. 4A) and t-shirt (FIG. 4B) preferably have a continuous outer fabric layer made from about 87% nylon, 13% elastane, with a control panel material made from a power mesh fabric of about 82% nylon, 18% Lycra®. The shorts shown in FIG. 4C preferably have a continuous outer fabric layer made from about 87% nylon, 13% elastane, and a control panel material made from a power mesh fabric of about 82% nylon, 18% Lycra®, and a 100% cotton gusset lining.

As can also be seen in FIGS. 4A-4C, shapewear garments in accordance with the present invention can be provided with ornamental stitching 4. For example, the tank top and t-shirt shown in FIGS. 4A and 4B have transverse stitching to provide the appearance of separate garment sections for the breast, tummy and bottom.

It should be noted that although the number of layers of material in the presently preferred embodiment of the shapewear garment has been described herein with respect to a particular number of layers, the actual number of layers in the shapewear garment may vary based on specific requirements of the garment being constructed, such as for a particular weight garment for a certain season of use. Accordingly, the number of layers of material shown in the presently preferred embodiment of FIGS. 1-4C is merely illustrative and in no way excludes other combinations of layers that may be employed by one of ordinary skill in the art to achieve the benefits of the present invention.

Although the present invention has been described in relation to particular embodiments thereof, many other variations and modifications will become apparent to those skilled in the art. As such, it will be readily evident to one of skill in the art based on the detailed description of the presently preferred embodiment of the shapewear garment explained herein, that different types of garments can be realized.

What is claimed is:

1. A shape control garment, comprising:

a fabric layer, formed in a shape of a top and configured to cover a front portion and a rear portion of an upper torso of a wearer's body when the shape control garment is worn by the wearer, the fabric layer having:

(a) an inner surface, facing the wearer's body when the shape control garment is worn by the wearer, (b) an outer surface, facing away from the wearer's body when the shape control garment is worn by the wearer, (c) a bust portion covering a bust area of the wearer's body when the shape control garment is worn by the wearer, and (d) a tummy portion covering an abdominal area of the wearer's body when the shape control garment is worn by the wearer; and a control layer having a top edge and a bottom edge each being affixed to at least a portion of the inner surface of the fabric layer so as to provide compression to a corresponding portion of the wearer's body, wherein the control layer is not viewable to an outside observer when the shape control garment is worn by the wearer, extends around both the front portion and the rear portion of the fabric layer, the top edge does not extend into the bust portion of the fabric layer, and the bottom edge does not extend beyond a lower edge of the fabric layer.

2. The shape control garment according to claim 1, wherein the fabric layer is a continuous, uniform fabric.

3. The shape control garment according to claim 1, wherein the fabric layer is formed of different fabric types attached together.

4. The shape control garment according to claim 1, wherein the fabric layer is made of one or more of fabrics selected from the group consisting of: lace, circular knit, warp knit, woven, cotton, nylon, polyester, and elastane.

5. The shape control garment according to claim 1, wherein the control layer is a power mesh material.

6. The shape control garment according to claim 1, wherein the fabric layer is made from about 87% nylon, 13% elastane, and the inner fabric layer comprises a control panel material made from about 82% nylon and 18% elastane.

7. The shape control garment according to claim 1, wherein the control layer is affixed to the inner surface of the fabric layer by sewing.

8. The shape control garment according to claim 1, wherein the control layer is affixed to the inner surface of the fabric layer by adhesive bonding.

9. The shape control garment according to claim 1, wherein the control layer is affixed to the inner surface of the fabric layer by ultrasonic bonding.

10. A shape control garment, comprising:

a fabric layer, formed in a shape of a top and configured to cover an upper torso of a wearer's body when the shape control garment is worn by the wearer, the fabric layer having:

(a) an inner surface, facing the wearer's body when the shape control garment is worn by the wearer, (b) an outer surface, facing away from the wearer's body when the shape control garment is worn by the wearer, (c) a bust portion covering a bust area of the wearer's body when the shape control garment is worn by the wearer, and (d) a tummy portion covering an abdominal area of the wearer's body when the shape control garment is worn by the wearer;

a control layer having a top edge and a bottom edge each being affixed to at least a portion of the inner surface of the fabric layer so as to provide compression to a portion of the wearer's body, wherein the control layer is not be viewable to an outside observer when the shape control garment is worn by the wearer, the top edge does not extend into the bust portion of the fabric layer, and the bottom edge does not extend beyond a lower edge of the fabric layer; and transverse ornamental stitching viewable on the outer surface of the fabric layer that provides an appearance of separate garment sections for breast, tummy and bottom.

* * * * *